US008194901B2

(12) United States Patent
Alber et al.

(10) Patent No.: US 8,194,901 B2
(45) Date of Patent: Jun. 5, 2012

(54) CONTROL DEVICE AND METHOD FOR WIRELESS AUDIO SIGNAL TRANSMISSION WITHIN THE CONTEXT OF HEARING DEVICE PROGRAMMING

(75) Inventors: Daniel Alber, Erlangen (DE); Thomas Lotter, Nümberg (DE); Jürgen Reithinger, Neunkirchen am Brand (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1349 days.

(21) Appl. No.: 11/881,125

(22) Filed: Jul. 25, 2007

(65) Prior Publication Data

US 2008/0031478 A1 Feb. 7, 2008

(30) Foreign Application Priority Data

Jul. 28, 2006 (DE) ..... 10 2006 035 127

(51) Int. Cl.
*H04R 25/00* (2006.01)

(52) U.S. Cl. ..... 381/314; 381/23.1; 381/60; 381/312; 381/313; 381/315

(58) Field of Classification Search ..... 381/23.1, 381/60, 314, 315
See application file for complete search history.

(56) References Cited

U.S. PATENT DOCUMENTS

| | | | | |
|---|---|---|---|---|
| 4,947,432 | A * | 8/1990 | Topholm | 381/315 |
| 5,604,812 | A * | 2/1997 | Meyer | 381/314 |
| 5,721,783 | A | 2/1998 | Anderson | |
| 6,240,194 | B1 | 5/2001 | De Koning | |
| 6,785,748 | B2 * | 8/2004 | Mikuni et al. | 710/15 |
| 7,054,957 | B2 * | 5/2006 | Armitage | 710/8 |
| 7,099,486 | B2 * | 8/2006 | Julstrom et al. | 381/331 |
| 7,127,541 | B2 * | 10/2006 | Govindarajulu et al. | 710/300 |
| 7,224,801 | B2 * | 5/2007 | Abdo et al. | 380/270 |
| 7,245,731 | B2 * | 7/2007 | Niederdrank et al. | 381/315 |
| 7,529,565 | B2 * | 5/2009 | Hilpisch et al. | 455/569.1 |
| 7,693,294 | B2 * | 4/2010 | Schneider et al. | 381/314 |
| 7,724,908 | B2 * | 5/2010 | Westergaard et al. | 381/60 |
| 7,738,913 | B2 * | 6/2010 | Hilpisch et al. | 455/550.1 |
| 7,961,891 | B2 * | 6/2011 | Dorfman et al. | 381/58 |
| 2003/0128855 | A1 * | 7/2003 | Moller | 381/314 |
| 2003/0132298 | A1 * | 7/2003 | Swartz et al. | 235/472.02 |
| 2003/0152243 | A1 * | 8/2003 | Julstrom et al. | 381/315 |
| 2004/0037428 | A1 * | 2/2004 | Keller | 381/60 |
| 2005/0008175 | A1 | 1/2005 | Hagen et al. | |

(Continued)

FOREIGN PATENT DOCUMENTS

| | | | |
|---|---|---|---|
| WO | 9641498 | A1 | 12/1996 |

(Continued)

OTHER PUBLICATIONS

Klaus David, Thorsten Benkner: "Digitate Mobilfunksysteme"; B. G. Teubner-Verlag-Verlag, 1996, pp. 330-333; ISBN 3-519-06181-3, Stuttgart.

*Primary Examiner* — Eugene Lee
*Assistant Examiner* — Mohammed Shamsuzzaman

(57) ABSTRACT

A method for programming a hearing device is described, in which audio data and programming data is transmitted from a programming device to the hearing device, with the audio data and the programming data being converted into data packets and transmitted via a common channel of a digital radio connection from the programming device to the hearing device.

7 Claims, 1 Drawing Sheet

U.S. PATENT DOCUMENTS

| | | | | |
|---|---|---|---|---|
| 2005/0053250 | A1* | 3/2005 | Jonkman | 381/312 |
| 2005/0100182 | A1* | 5/2005 | Sykes et al. | 381/315 |
| 2005/0111680 | A1* | 5/2005 | Meier et al. | 381/314 |
| 2005/0157896 | A1* | 7/2005 | Maltan et al. | 381/315 |
| 2005/0201577 | A1* | 9/2005 | Kariniemi | 381/312 |
| 2005/0283263 | A1 | 12/2005 | Eaton et al. | |
| 2006/0078139 | A1* | 4/2006 | Meier et al. | 381/312 |
| 2006/0093172 | A1* | 5/2006 | Ludvigsen et al. | 381/315 |
| 2006/0093997 | A1* | 5/2006 | Kearby et al. | 434/185 |
| 2006/0269088 | A1* | 11/2006 | Julstrom et al. | 381/315 |
| 2006/0291680 | A1* | 12/2006 | Roeck | 381/315 |
| 2007/0269065 | A1 | 11/2007 | Kilsgaard | |

FOREIGN PATENT DOCUMENTS

| | | | |
|---|---|---|---|
| WO | WO 01/54458 | A2 | 7/2001 |
| WO | 2006074655 | A1 | 1/2008 |

* cited by examiner

CONTROL DEVICE AND METHOD FOR WIRELESS AUDIO SIGNAL TRANSMISSION WITHIN THE CONTEXT OF HEARING DEVICE PROGRAMMING

CROSS REFERENCE TO RELATED APPLICATIONS

This application claims priority of German application No. 10 2006 035 127.4 filed Jul. 28, 2006, which is incorporated by reference herein in its entirety.

FIELD OF THE INVENTION

The invention relates to a method for controlling a hearing device, whereby, within the context of programming, control data and audio data of a control device are jointly transmitted over a wireless connection to the hearing device. The data is preferably transmitted in such cases as data packets with the aid of an inductive short-range radio transmission method.

BACKGROUND OF THE INVENTION

In the early days of hearing device technology the hearing devices merely served as simple sound amplifiers. Since with a hearing impairment not all frequencies are typically equally affected, with some frequencies thus being able to be perceived better than others, frequency-dependent amplification is necessary to compensate for the hearing impairment in the optimum way. Only by the use of filter circuits could the transmission characteristics of the hearing device, i.e. the manner in which an audio signal is modified by the components of the hearing device, be individually adapted to the extent where a realistic hearing impression was possible. The filter circuits realized initially with the aid of analog technology have become ever more mature during the course of development, with the increasing complexity of these circuits also resulting in a plurality of adjustment and control options. In newer designs of hearing device the signal processing of the audio signal received from the hearing device microphone may thus be adapted so that it meets the individual requirements of the respective hearing device wearer. The adaptation of the hearing device aims to optimize the settings of the hearing device and this procedure is generally undertaken by a hearing device acoustic technician.

A significant advantage of analog technology is that the signals are processed in real time. However settings can only be made on analog signal processing circuits to a limited extent as a result of the small size of the hearing device. The noise typical of analog signal processing also represents a not insignificant problem. The disadvantages of analog technology could not be avoided until the advent of digital signal processing circuits in hearing device technology. Programmable hearing devices basically open up new degrees of freedom in defining the functionality of a hearing device. The type of signal processing in this case is fully freely definable and can be executed in the form of programs in the hearing device. Only the development of digital programmable hearing devices thus made it possible to provide a number of alternate hearing programs which are intended for example to provide optimum perception of speech when confronted with various noise barriers.

The hearing devices on the market essentially feature the same basic components. In addition to a microphone, a signal processing device and an electroacoustic converter, generally a loudspeaker, modern hearing devices also have a programmable control device which controls the signal processing device, to set the transmission characteristics of the hearing device to individual requirements. The control device is preferably programmed in this case with the aid of data obtained audiometrically.

Since the hearing device does not as rule have a complex adjuster because of the small size of its housing, it has to be programmed in a programming session with the aid of an external control device. Real everyday situations are simulated during the programming. Different audio samples can be copied into the hearing device via the control device for this purpose, which, after signal processing in the hearing device, are qualitatively assessed by the hearing aid wearer. This feedback allows the acoustic technician to manually set individual parameters during fine tuning. Typically the control device or an external adaptation computer connected to the control device features corresponding input devices for this purpose. The adaptation of the hearing device is preferably undertaken here in a number of stages. Preprogramming can thus initially be undertaken on the basis of audiometrically determined parameters and the hearing device can then be fine tuned.

During fine tuning it is necessary to transmit audio signals with the optimum possible quality to the hearing device. Thus the hearing device is conventionally connected to the programming device for programming via a special audio cable. Since in such cases complex tine sequences and noises sometimes have to be created or analyzed, the programming of the hearing device requires a comparatively large amount of computing power. It is thus advantageous to use an external adaptation computer for programming which is connected to the control device. Such an adaptation computer generally features an operator keyboard, via which the hearing device acoustic technician can make the corresponding settings. The control device does not need any processing power of its own in this case. Instead it can then be embodied as a simple remote control, which merely forwards the data of the adaptation computer to the hearing device. Such a remote control can however also contain closed-loop controllers for specific setting of the hearing device, such as the absolute volume for example. Furthermore the remote control can feature a separate tone generator which creates audio signals from data calculated by the adaptation computer and transferred to the control device. These audio signals only then have to be transmitted on to the hearing device. This type of simple control device is as a rule correspondingly small so that it can be worn directly on the body. To achieve a greater freedom of movement for the hearing aid wearer during a programming session, the control device can in this case be connected wirelessly to the adaptation computer instead of via cables.

With newer designs of programming system the control data for the programming of the hearing device can already be transmitted using wireless data transmission from the control device to the hearing device. Use is made of a wireless interface already integrated into the hearing device for this purpose. Audio signals also continue to be transmitted however by means of a special cable connection. With this type of transmission a cable must be directly accommodated on the hearing device. The freedom of movement of the hearing device wearer is restricted by the cable however. In addition a cable pulling on the hearing device can change the seating of the hearing device and thus also change the hearing impression, which can have a negative effect on the hearing device adaptation.

Finally analog modulated radio systems are also known with which audio signals from external sources can be coupled wirelessly into the hearing device. These devices embodied as external radio modules are plugged into an audio shoe of the hearing device. They use VHF frequencies and have a separate power supply. However a specific radio module is needed for each hearing device, since hearing devices vary from manufacturer to manufacturer. Furthermore radio modules plugged into the hearing device can also change the seating of the hearing device which can also have a negative effect on the hearing device adaptation.

SUMMARY OF THE INVENTION

The object of the invention is thus to provide a method for wireless programming of a hearing device in which the hearing device can be connected completely wirelessly to a control device. This connection is to make do without any additional devices. It is also the task of the invention to provide a control device as well as a hearing device for executing the method. In accordance with the invention this object is achieved by a method, a control device as well as a hearing device as claimed in the claims. Further advantageous embodiments of the invention are specified in the dependent claims.

In accordance with the invention a method is provided for controlling a hearing device in which control data is transmitted wirelessly from a control device to the hearing device, in order to set the transmission characteristics between the hearing device microphone and the output converter of the hearing device. Furthermore audio data is transmitted from the control device to the hearing device in order to test the current transmission characteristics of the hearing device. The audio and control data converted into data packets is transmitted in this case jointly over a digital radio connection from the control device to the hearing device. The joint transmission of data over the same radio channel enables a completely wireless connection of the hearing device to the control device without additional devices. This enables full freedom of movement to be guaranteed for the hearing device wearer during the programming. This can also simultaneously reduce the risk of the hearing device slipping out of position during the programming. There is also no longer any necessity for specific plug-in modules for the hearing device. This also makes it possible to dispense with the programming socket. This results in a smaller design of hearing device. Furthermore analog audio transmission is principally possible without an audio shoe, directly into the hearing device.

In an advantageous embodiment of the invention audio and control data is transmitted in separate data packets to the hearing device. This makes it possible to explicitly only transmit control data if the current transmission capacity allows this. Provided the full bandwidth of the radio connection is needed for the audio data transmission control data can also be held back until sufficient transmission capacity is available.

An especially advantageous embodiment of the invention makes provision for the audio data and the control data to be transmitted in joint data packets to the hearing device, with each data packet featuring a payload data block and a header preceding the payload data block. Whereas the audio data is transmitted in the payload data block of a data packet in each case, the control data is transmitted in the packet header of the data packet in each case. Since in practice only a relatively small volume of control data by comparison with the volume of audio data arising must be transmitted, this transmission path has the advantage that almost the entire bandwidth of the radio connection is available for transmission of audio data.

In addition a further embodiment of the invention provides for the data to be transmitted by means of an inductive short range radio connection. Over short distances this wireless connection allows audio data to also be transmitted with sufficiently high quality where necessary at an increased data rate when compared to normal operation. Especially advantageous is the relatively low energy consumption of this radio connection. A suitable, lossy, digital compression method can assist in this case in keeping the data rate small with convincing quality.

As provided by a further advantageous embodiment of the invention, the digital radio link used for transmission of the data uses digital radio connection frequencies in the RF range. A sufficiently high audio quality can be ensured in this way.

A further advantageous embodiment of invention provides for an external control device for controlling a hearing device, which features a transmitter to transmit control data and audio data to a receiver of the hearing device. The transmitter is embodied in this case for transmission of the control data and the audio data jointly over a digital radio connection to the receiver of the hearing device. The joint transmission of the data allows the cable connection to the hearing device to be dispensed with entirely. This allows the freedom of movement of the hearing device to be increased.

Furthermore an embodiment of the invention makes provision for a control device in which an interface is provided for connecting the control device wirelessly or by means of a cable to a data processing system. By using an external adaptation computer more complex audio signals can also be created and processed which the control device is unable to process because of its typically low computing power.

A further embodiment of the invention makes provision for the control device to have an internal power supply device in the form of a battery or a rechargeable cell. This enables the control device to be operated completely wirelessly.

Furthermore an embodiment of the invention makes provision for the control device to feature a tone generator. This enables desired audio signals to be created in the control device and subsequently sent as audio data to the hearing device. It is of advantage in such cases for the volumes of data transmitted between the adaptation computer and the control device not to have to be too great, but merely to be the commands necessary for the tone generation of the tone generator.

Finally, in an advantageous embodiment of the invention there is provision for the receiving apparatus to be embodied as an inductive receiver which receives the audio data and the control data via a magnetic radio connection. For hearing devices which already have an inductive receiver for receiving control data, the invention can be implemented on the basis of the existing system without additional hardware.

BRIEF DESCRIPTION OF THE DRAWINGS

The invention is explained in more detail below with reference to an exemplary embodiment in connection with the enclosed drawing. The drawing shows the following.

DETAILED DESCRIPTION OF THE INVENTION

Figure 1:
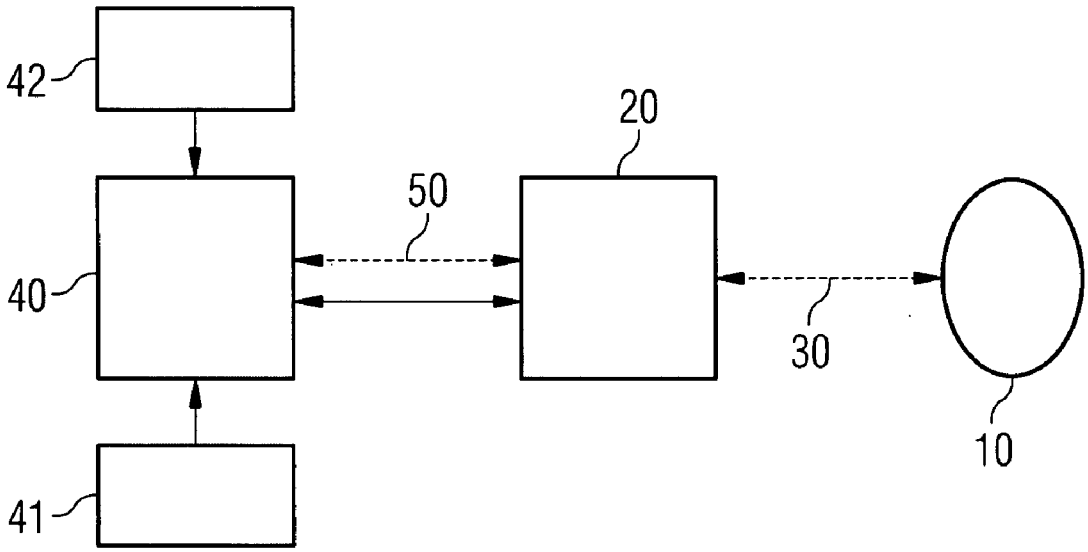
FIG. 1 an inventive programming system for a hearing device with a control device, a data processing system and a programmable hearing device connected wirelessly to the control device.

FIG. 1 shows a purely schematic diagram, without any scale relationships, of a control system for hearing devices which can be used for wireless programming of a hearing device. This system comprises a programmable hearing device 10, a control device 20 as well as an external adaptation computer 40. The adaptation computer 40 embodied as a data processing system is needed if the programming of a digital hearing device requires a large amount of processing power and the control device 20 cannot make this computing power available. In this case the control device 20 can also be embodied solely as a remote control, which forwards the data of the adaptation computer 40 to the hearing device wirelessly. In such cases audio data can be digitized in the adaptation computer and be present already encoded. The remote control 20 then preferably transmits it without any separate processing to the hearing device 10. Only the channel coding for the data packets must then has to be provided. The audio data is then only decoded again in the hearing device 10 and output as audio signals via the audio device loudspeaker 132. Furthermore audio signals of an external audio source 41 are coupled in via a corresponding interface in the adaptation computer 40 or into the control device 20.

The control device 20 used solely as a remote control can feature devices for controlling specific settings such as the volume of the hearing device for example. Depending the application it is also possible to provide a control device 20 which has sufficient computing power so that audio signals can be processed or transcoded in the control device 20.

The adaptation computer 40 used in the present example for injection of audio data preferably has a device for input of commands or data as well as a display device for presentation of information. The adaptation computer 40 is used for providing the parameters necessary for the programming of the bearing device 10. To this end the adaptation computer 40 is connected via a specific connection 50 to the control device 20. Depending on the application the connection 50 is a wireless or a wired bidirectional connection. This is indicated in FIG. 1 by a dashed or solid arrow.

Figure 2:
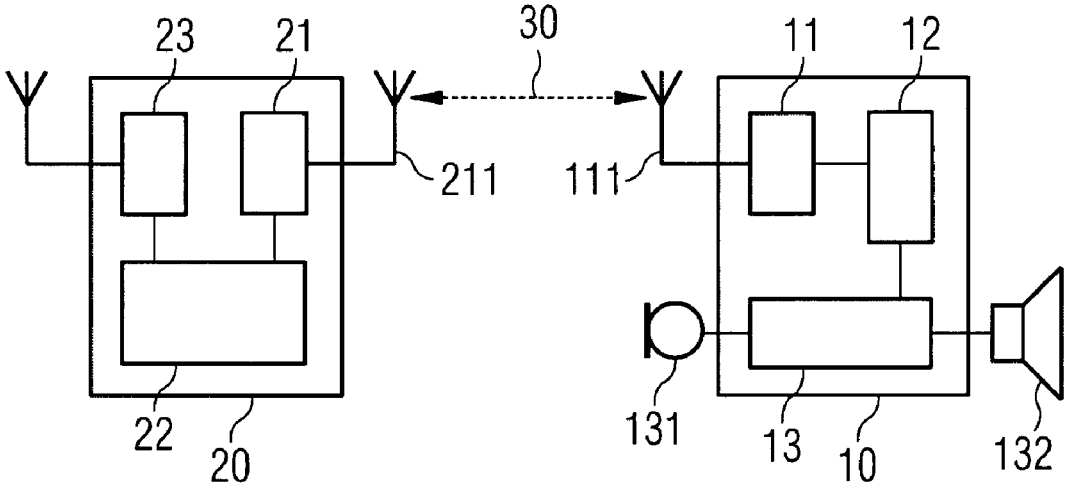
FIG. 2 an inventive control device and a programmable hearing device, each with devices for wireless transmission of control and audio data.

In accordance with the invention the control device 20 is further connected via a separate wireless connection 30 to the hearing device 10. As is shown in FIG. 2 both the hearing device 10 and also the control device 20 have the appropriate transmit/receive devices 21, 11 as well as the appropriate antennas 111, 211 for this purpose. Furthermore the hearing device 10 can have just a receiver 11 and the control device 20 just a transmitter 21 if there is only provision for unidirectional data transmission. The wireless connection 30 is preferably embodied as a digital short-range radio link. Because of the relatively short distance to be covered in such cases an inductive or magnetic radio connection is especially suitable here. In this case the signals are only transmitted by means of the magnetic field. By comparison with an electromagnetic radio connection this radio method stands out by virtue of being far more energy-efficient for the receiver. This is especially advantageous if only an internal battery is available to the hearing device 10 during programming as a source of energy. Since in addition to the control data, audio data is also to be transmitted wirelessly in accordance with the invention, the radio connection 30 must have a sufficiently high bandwidth. In order to transmit audio signals in of sufficiently good quality a data rate of at least 50 to 100 kbit/s is necessary as a rule. For a purely inductive data transmission carrier frequencies in the range of several Megahertz must therefore be used. Preferably the carrier-frequency for the inductive data transmission lies in the HF range, especially in the range of 3 to 5 MHz.

The control device 20 can likewise span the relatively long distance to the adaptation computer 40 by means of a suitable wireless connection 50. As shown in FIG. 2, the control device 20 has a further transceiver 23 for this purpose. If the data is sent wirelessly from the adaptation computer 40 to the control device 20, it arrives encoded for the corresponding radio standard in the control device 20. Where the short-range radio transmission method to the hearing device 10 requires a different encoding, the data must be transcoded to the corresponding radio standard of the short-range radio connection 30. This preferably occurs in a control device 22 of the control device 20.

For programming the hearing device 10 control data is sent in the present example from the adaptation computer 40 via the data connection 50 to the control device 20. This control data generally contains specific control commands or parameters for the controller 12 of the hearing device 10. If necessary the control device 20 must convert the control data before forwarding it via the digital radio connection 30 to the hearing device 10. Control data can also be entered manually via an input device 42, such as a keyboard of the adaptation computer 40 for example.

In the optimization of the transmission characteristics of the hearing device 10 different audio samples are played to the hearing device wearer. To this end audio data already stored in the adaptation computer 40 or audio data copied into the adaptation computer 40 from an external audio source 41 can be sent over the radio connection 50 to the control device 20. The audio data too must if necessary be converted in the control device 20, before it is transmitted via the digital radio connection 30 to the hearing device 10.

Furthermore it is also possible to create audio signals only in the control device 20. To this end the control device 20 preferably features a tone generator. In this case the adaptation computer 40 supplies the necessary control commands for the tone generation via the data connection 50 for the tone generator of the control device 20. The audio signals must then only be encoded in the control device 20 and prepared for wireless transmission to the hearing device 10.

For a block-by-block data transmission the audio data and the control data is typically packed into data packets. These data packets can vary in length. As a rule however they may not exceed a fixed upper limit. If there are likely to be relatively many errors in a faulty transmission, a relatively small value is selected for this upper limit, in order not to have to repeat a unnecessarily large volume of data.

In the conversion into data packets the data is packed into frames, i.e. with a headers at the start of the frame and as a rule also with a trailer at the end of the frame. The header block, in addition to address information (address bits), generally contains further bits, especially marking bits (flag) and so-called control bits. On the basis of the flags the receiver can detect the position of the frames in the bit stream. The control bits on the other hand are used for transmission control. In addition the header block can contain further bits. By comparison with the payload data block, which contains the actual data, the header of a typical data packet generally contains far fewer data bits. In the Bluetooth data transmission method this is 54 bits for example. By contrast an associated payload data block of the Bluetooth transmission method typically features up to 2745 bits.

Despite the relatively small number of bits a few bytes of information can also be transmitted in the header block of a frame. Preferably this information should contain programming data for the respective hearing device 10. The programming data can be protected against transmission errors in this case by means of corresponding encoding. Furthermore multiple transmission can be used to ensure that no data gets lost. On the other hand audio data is preferably transmitted in the payload data block, i.e. the actual data areas outside the header. Since the header data is transmitted in addition to the audio data in the same period of time, the transmission rate must be somewhat higher than the actual radio data rate.

In the joint transmission of programming data in the header block and audio data in the payload data block transmission gaps occur in the audio receive branch. These can be compensated for again in the audio receive branch by means of buffer storage, so that this results in no signal delay or only a relatively small signal delay. On receipt of the data blocks in the hearing device 10 further processing of the headers of the audio data is undertaken separately and independently.

Since with the described method a simultaneous transmission of audio data and programming data in a single radio channel can be implemented, it is possible to program a hearing device 10 for corresponding encoding of the data and use of header information in parallel to audio transmission. In this case only the programming data rate is reduced by the simultaneous audio transmission. Since in the transmit case it is not possible to read out the data for half-duplex systems without interrupting the transmit process and thereby the audio transmission, the programming data can be sufficiently protected by means suitable error correction methods.

Basically a return channel can also be implemented in this way. This can be done for example by means of a time division multiplexing method. To this end small data packets are preferably sent back between the individual frames to the control device 20. The small data packets are transmitted in this case on the same radio channel and on the same carrier wave as the transmission of the audio and programming data. However the use of the time division multiplexing method causes the payload data rate to fall even further. To ensure a fault and interruption-free audio transmission in such a case a sufficiently large reserve is necessary. The data transmission method used must therefore have a sufficiently high data rate.

The invention claimed is:

1. A method for controlling a hearing device, comprising:

setting a transmission characteristic of the hearing device by transmitting a control data from a control device to the hearing device over a radio connection; and testing the transmission characteristic of the hearing device by jointly transmitting an audio data with the control data from the control device to the hearing device over the radio connection.

2. The method as claimed in claim 1, wherein the audio data and the control data are transmitted in different data packets.

3. The method as claimed in claim 1, wherein the audio data and the control data are transmitted in a joint data packet comprising a payload data block and a packet header preceding the payload data block, and wherein the audio data is transmitted in the payload data block and the control data is transmitted in the packet header.

4. The method as claimed in claim 1, wherein the radio connection is a digital radio connection.

5. The method as claimed in claim 1, wherein the radio connection is an inductive short-range radio link.

6. The method as claimed in claim 1, wherein the radio connection uses frequencies in a HF range.

7. The method as claimed in claim 1, wherein the audio data and the control data are transmitted within a framework of hearing device programming and a controller of the hearing device that controls the transmission characteristics of the hearing device is programmed based on the control data.

* * * * *